US011613403B2

(12) United States Patent
Davis

(10) Patent No.: US 11,613,403 B2
(45) Date of Patent: Mar. 28, 2023

(54) BLANK AND BOX

(71) Applicant: Colin Davis, Kaneohe, HI (US)

(72) Inventor: Colin Davis, Kaneohe, HI (US)

( * ) Notice: Subject to any disclaimer, the term of this patent is extended or adjusted under 35 U.S.C. 154(b) by 0 days.

(21) Appl. No.: 17/363,198

(22) Filed: Jun. 30, 2021

(65) Prior Publication Data

US 2023/0002109 A1 Jan. 5, 2023

(51) Int. Cl.

*B65D 5/54* (2006.01)
*B65D 5/20* (2006.01)
*B65D 5/50* (2006.01)

(52) U.S. Cl.

CPC ..... *B65D 5/541* (2013.01); *B65D 5/2052* (2013.01); *B65D 5/5016* (2013.01); *B65D 5/5445* (2013.01)

(58) Field of Classification Search

CPC .. B65D 5/5445; B65D 5/5016; B65D 5/2052; B65D 5/54; B65D 5/542; B65D 2571/00728; B65D 5/48014; B65D 71/36; B65D 25/103; B65D 5/003; B65D 5/504; B65D 5/541

USPC ..... 229/100, 242, 178, 235, 117, 924, 925; 206/746

See application file for complete search history.

(56) References Cited

U.S. PATENT DOCUMENTS

| | | | | |
|---|---|---|---|---|
| 3,469,766 | A * | 9/1969 | Nelson | B65D 5/5445 229/164 |
| 5,251,819 | A * | 10/1993 | McHugh | B65D 5/5425 493/183 |
| 5,507,432 | A * | 4/1996 | Cyr | B65D 5/54 229/235 |
| 7,472,819 | B1 * | 1/2009 | Wachter | B65D 5/16 229/164 |
| 7,607,566 | B2 * | 10/2009 | Philips | B65D 5/10 229/242 |
| 11,072,457 | B2 * | 7/2021 | Gressel | B65D 5/5405 |
| 11,396,398 | B2 * | 7/2022 | Gressel | B65D 5/4608 |
| 2013/0306718 | A1 * | 11/2013 | Sumpmann | B65D 5/743 53/410 |
| 2019/0009946 | A1 * | 1/2019 | Nixon | B65D 5/4266 |
| 2019/0135482 | A1 * | 5/2019 | Pratsch | B65D 5/542 |

FOREIGN PATENT DOCUMENTS

| | | | | |
|---|---|---|---|---|
| DE | 20000449 U1 * | 4/2000 | | B65D 5/4608 |

* cited by examiner

*Primary Examiner* — Christopher R Demeree
(74) *Attorney, Agent, or Firm* — Pauley Erickson & Swanson

(57) ABSTRACT

A blank for forming a box for packaging and displaying objects includes a flexible sheet with a plurality of panels that fold into a box. Perforated lines of weakness extend between rows of the plurality of panels. A lateral row along the plurality of panels includes a plurality of tabs from which to display the objects.

16 Claims, 5 Drawing Sheets

BLANK AND BOX

BACKGROUND OF THE INVENTION

Field of the Invention

This invention relates generally to a blank that is formed into a box and, more particularly, a blank with additional features in order to display objects from the box.

Description of Prior Art

Blanks or sheets used to create boxes of various kinds are known. Blanks often are die cut, from various materials, into specific shapes and sizes to create various types of boxes. The blanks typically include lines of weakness (such as perforated or scored lines) at points along the blank. These lines of weakness aid in folding and shaping the blank to form the resulting box.

Some blanks include additional lines of weakness or features that allow the formed boxes to be used for additional purposes. While boxes may be used to store or transport items, they can also be used to display items. One such example known in the art is the use of one or more perforated sections on a box that can be removed. The result is a portion of the box remaining that provides a different shape and/or carrying capacity of the box so that the objects inside the box may be more easily accessed or displayed, such as on retail shelves.

The removed portions of the box are generally discarded. As such, while part of the box may be used, most of the box is discarded after objects are removed from the box. Therefore, there is an additional need to provide display options for objects, both for ease in displaying (such as to display objects for sale to consumers), and to provide additional uses for the box transporting the objects.

SUMMARY OF THE INVENTION

The invention generally relates to a blank for forming a box, where the box can also be modified to create a variety of displays.

The general object of the invention can be attained, at least in part, through a blank for forming a box for packaging and displaying objects, specifically objects for retail sale. The blank includes a flexible sheet having a plurality of panels that fold into a box, a perforated line of weakness extending between rows of the plurality of panels, and a plurality of tabs in a lateral row along at least one row of the plurality of panels. The plurality of panels includes a row of lateral panels along the flexible sheet, a row of top panels above the lateral panels, and a row of bottom panels below the lateral panels. The row of top panels forms a top of the box. The top includes a lid flap and two opposing side flaps.

The row of bottom panels foul's a bottom of the box. The bottom of the box includes two sets of transverse flaps. The two sets of transverse flaps fit inside one another or abut one another to form the bottom of the box. The row of lateral panels includes four lateral panels that form four walls of the box. The four walls include a front wall, a rear wall, a first side wall, and a second side wall.

A first panel of the row of lateral panels includes a circular perforation. The circular perforation is at one end of the tabs, in line with the tabs. The row of lateral panels includes a first line of weakness extending transversely across a width of the row of lateral panels. The row of lateral panels also includes a second line of weakness extending transversely across the width of the row of lateral panels. The second line of weakness is parallel to the first line of weakness. The first line of weakness and the second line of weakness are preferably perforated, forming a perforated strip. The perforated strip is thus removable from the sheet.

The first panel of the row of lateral panels preferably includes a void on a first outside edge of the sheet. The void is aligned with the perforated strip. The perforated strip includes a tear tab for detaching the perforated strip from the sheet. The tear tab extends through the void. The fourth panel of the row of lateral panels includes a sealing flap on a second outside edge of the sheet. The sealing flap includes a void aligned with the perforated strip.

The sheet also preferably includes a perforated line of weakness between the fourth panel and the sealing flap. This perforated line of weakness extends a length of the sealing flap.

The sheet also preferably includes a line of weakness between each panel of the row of lateral panels. The lines of weakness extend longitudinally, down a length of the row of lateral panels. The sealing flap attaches to the first outside edge of the sheet, thereby connecting the fourth panel to the first panel, when creating the box. The row of lateral panels folds along the lines of weakness.

The general object of this invention can also be attained through a box for holding and displaying a plurality of articles. The box includes a top with a foldover flap, and two side flaps. The foldover flap is moveable between a closed position and an opened position. The box also includes a bottom with a plurality of bottom flaps for closing the bottom of the box and a plurality of side walls foldably connected to a sealing flap. A first side wall of the plurality of side walls is foldably connected to a side flap of the two side flaps along a perforated line of weakness. The first side wall is foldably connected to a bottom flap of the plurality of bottoms flaps along a scored line of weakness.

A first perforated line of weakness preferably extends transversely across a width of the plurality of side walls. A second perforated line of weakness preferably extends transversely across the width of the plurality of side walls. The second line of weakness is parallel to the first line of weakness, forming a perforated strip. A plurality of tabs are included in a lateral row along the plurality of side walls. The lateral row is configured along a centerline between the first perforated line of weakness and a top of the plurality of side walls. There is also a circular perforation on the first side wall along the lateral row. U-bends of the tabs point towards the circular perforation.

The box for holding and displaying a plurality of articles also includes a void on an edge of the first side wall. The void is aligned with the perforated strip. The perforated strip includes a tear tab extendable into the void. The perforated strip is removed from the box with the tear tab to create a tray to display the plurality of articles. The tray includes the bottom of the box and a portion of the plurality of side walls.

The foldover flap and the two side flaps of the top of the box are removed from the plurality of side walls at the perforated lines of weakness. The sealing flap is removed from the fourth side wall at the perforated line of weakness to create a display strip to display the plurality of articles. The display strip creates a hangable display by the circular perforation. Each article of the plurality of articles can be hung on the hangable display on a respective tab.

Another embodiment of this invention includes a blank for forming a box for packaging and displaying objects. The blank includes a plurality of panels adapted to fold into the box, a first perforated line of weakness extending between rows of the plurality of panels, and a second perforated line of weakness extending between rows of the plurality of panels. The second perforated line of weakness is parallel to the first perforated line of weakness. The blank also includes a plurality of tabs in a lateral row along at least one row of the plurality of panels and a circular perforation on an end of the lateral row. U-bends of the tabs point towards the circular perforation.

The plurality of panels includes a series of top panels. The series of top panels are removed from the plurality of panels at a plurality of perforated points. The first perforated line of weakness and the second perforated line of weakness comprise a removeable strip. The removeable strip is removed from the plurality of panels.

This invention also includes a method of displaying objects. The method includes packaging a plurality of objects in a box, removing a perforated portion from the box along at least one line of weakness and forming a display for the objects. In one embodiment the display includes a tray formed from a portion of a bottom of the box. At least a portion of the plurality of objects are displayed in the tray. In another embodiment, the display includes removing a top portion from the box and unfolding a panel portion of the box to reveal a display strip. The display strip includes a circular perforation on an end of the display strip. This display also includes puncturing the circular perforation and hanging the display strip from the circular perforation. The display strip also includes a plurality of tabs in a row. U-bends of the tabs point towards the circular perforation. The display additionally includes puncturing the tabs and hanging at least a portion of the plurality of objects from the tabs.

Other objects and advantages will be apparent to those skilled in the art from the following detailed description taken in conjunction with the appended claims and drawings.

DETAILED DESCRIPTION OF THE INVENTION

The present invention provides a blank for forming a box. The box is used to store and transport objects or other items or articles. After transport, the box can be dually used to display the objects. The box includes a variety of types and positions of lines of weakness which allow modifications to the box so that the box can be transformed into a display for the objects.

Figure 1:
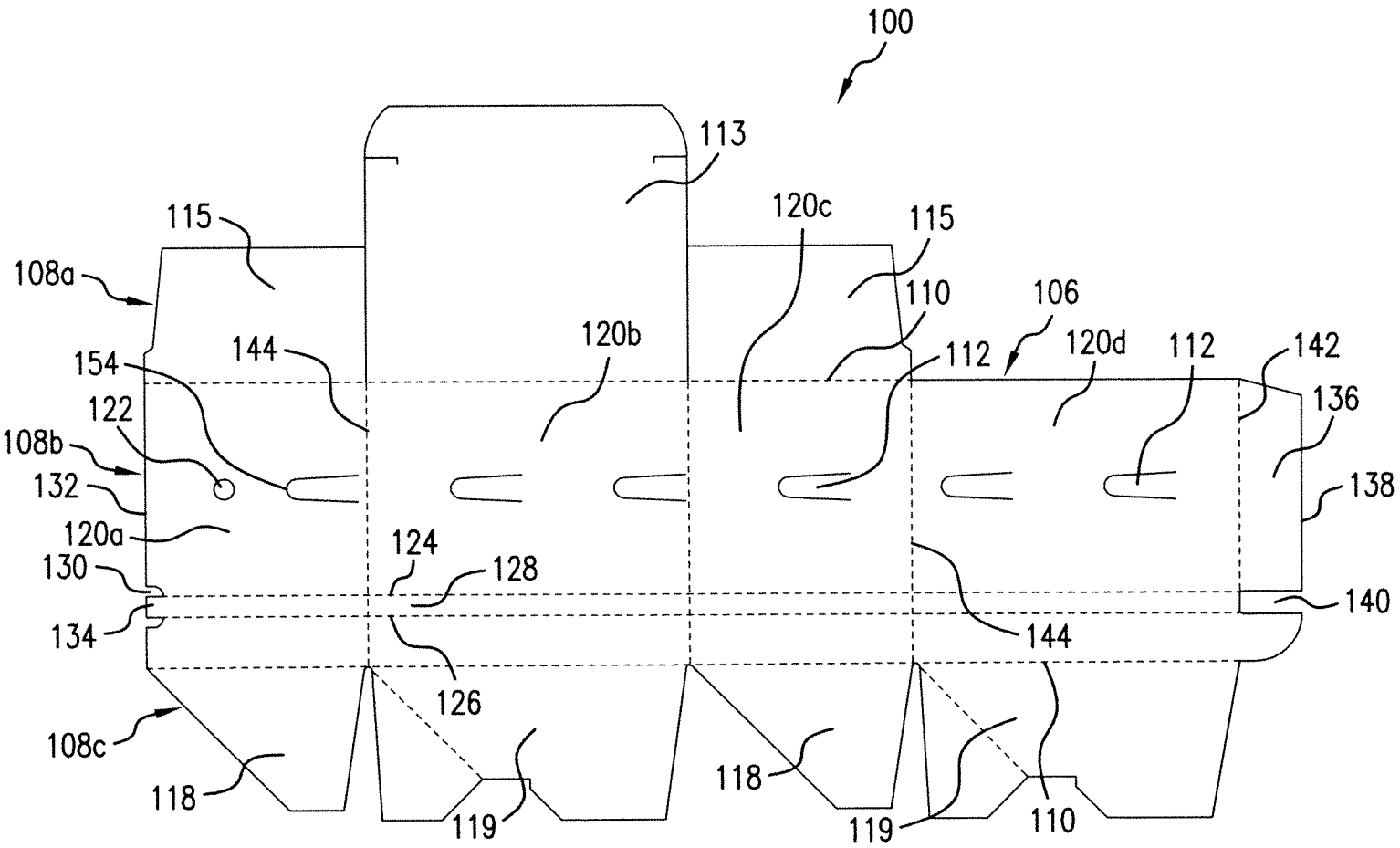
FIG. 1 shows a blank for forming a box according to one embodiment of the invention.

FIG. 1 shows a blank 100 for forming a box according to one embodiment of the invention. The blank 100 is made of a flexible sheet 106. The flexible sheet can be made from a variety of materials, preferably cardboard. The flexible sheet 106 includes a variety of panels 108. These panels 108 are subsequently folded into a box (shown later in additional figures). The panels 108 are split into three general rows: a row of top panels 108*a*, a row of lateral panels 108*b*, and a row of bottom panels 108*c*. The rows of panels are separated by at least one perforated lines of weakness 110 that extends between the rows of panels.

Regarding the row of top panels 108*a*, the top panels include a lid flap or foldover flap 113, and two opposing side flaps 115. Regarding the row of bottom panels 108*c*, the bottom panels include two sets of transverse flaps 118, 119. The first set of transverse flaps 118 are of like size and shape. The second set of transverse flaps 119 are also of like size and shape. The sets of the transverse flaps are arranged so that the sets are arranged to alternate with one another on the blank 100 (from left to right on the blank as shown: 118, 119, 118, 119). The sets of bottoms flaps 118, 119 are of a particular size and shape so that the flaps fit into one another to form a bottom of a box when the blank is folded. Alternatively, the flaps may overlay each other and be fastened with tape or glue. The lid flap and side flaps 113, 115 are of a particular size and shape so that these flaps fold and fit into or onto one another to form a top of a box when the blank is folded and the box is in a closed position. However, the top and bottom of the box can be folded and arranged in a variety of ways with a variety of types of top and bottom flaps. For example, the top and/or bottom of the box can be created by folding the flaps in a complimentary matter such as those shown in the subject embodiment. The top and/or bottom of the box can also include flaps that need to be folded and sealed such as with glue or tape.

Regarding the row of lateral panels 108*b*, the lateral panels include four lateral panels 120*a*, 120*b*, 120*c*, and 120*d* arranged in a row from left to right on the blank 100. The four lateral panels are separated from one another by lines of weakness 144. The first lateral panel 120*a* and the third lateral panel 120*c* are of like size and shape. The second lateral panel 120*b* and the fourth lateral panel 120*d* are of like size and shape. The row of lateral panels 108*b* also includes a plurality of tabs 112. The tabs are preferably u-shaped, although other shapes may also be used. The tabs 112 are aligned in a lateral row across the row of lateral panels 108*b*. One end of the lateral row of tabs includes a circular perforation 122. The circular perforation 122 is in line with the tabs. The circular perforation 122 is located on the first panel 120*a* of the row of lateral panels 108*b*. The tabs 112 are aligned so that u-bends 154 of the tabs point towards the circular perforation 122. The circular perforation 122 and the tabs 112, are preferably spaced equidistant from one another along the row of lateral panels 108*b*. As shown, this includes the circular perforation 122 and one tab 112 on the first lateral panel 120*a*, two tabs 112 on the second lateral panel 120*b*, one tab 112 on the third lateral panel 120*c*, and two tabs 112 on the fourth lateral panel 120*d*, although other layouts can also be included.

The fourth panel 120*d* of the lateral panels additionally includes a sealing flap 136 on an outside edge 138 of the blank 100. The sealing flap 136 is separated from the fourth panel 120*d* by a line of weakness 142. The line of weakness 142 is preferably perforated, and extends down a length of the fourth lateral panel 120*d*.

The first panel 120*a* of the lateral panels additionally includes a void 130 on another outside edge 132 of the blank 100. A tear tab 134 protrudes into the void 130 from the first lateral panel 120*a*. The tear tab 134 extends into a first line of weakness 124. The first line of weakness 124 extends laterally across the row of lateral panels 108*b*. The tear tab 134 also extends into a second line of weakness 126. The second line of weakness 126 also extends laterally across the row of lateral panels 108*b*, in parallel with the first line of weakness 124. Both the first line of weakness 124 and the second line of weakness 126 are preferably perforated. Together, the first and second lines of weakness 124, 126 form a perforated strip 128. The perforated strip 128 begins at the tear tab 134, and ends at a void 140. The void 140 is in line with the first and second lines of weakness 124, 126. The void 140 is on a portion of the sealing flap 136 so that the tear tab 134 remains accessible when the blank 100 is formed into a box.

Figure 2:
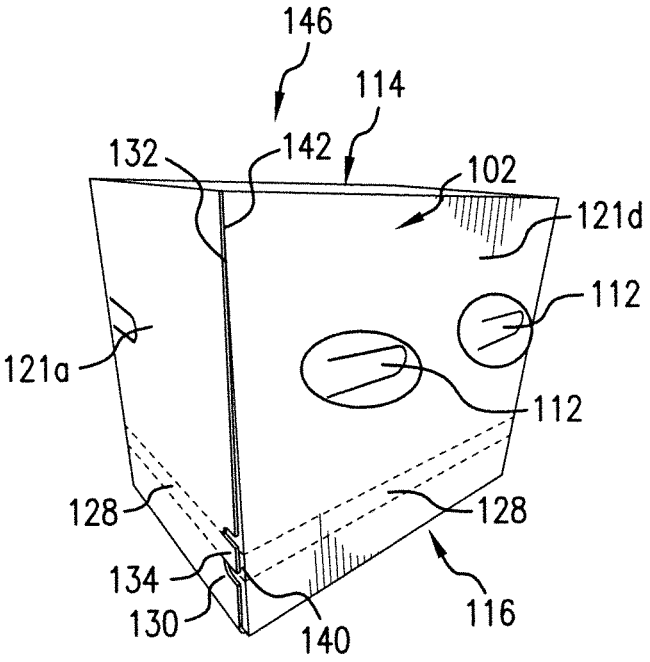
FIG. 2 shows a perspective view of a box in a closed position according to one embodiment of the invention.

The blank 100 is formed into a box 102, as shown in FIG. 2 by folding the blank 100 at the various lines of weakness 110, 142, 144. The box 102 is shown in a closed position 146. The lid or foldover flap 113, and two side flaps 115 form a top 114 of the box. The first lateral panel 120*a* becomes a front wall 121*a*. The second lateral panel 120*b* becomes a first side wall 121*b* (not shown). The third lateral panel 120*c* becomes a rear wall 121*c* (not shown). The fourth lateral panel 120*d* becomes a second side wall 121*d*. The sealing flap 136 is attached to the front wall 121*a* to seal the box at the edge 132. The sealing flap 136 is preferably glued to the front wall 121*a*, however other means of attachment may be used. Once the box 102 is formed, the tear tab 134 overlaps with void 140. The perforated strip 128 begins at the tear tab 134 and surrounds a perimeter of the box near a bottom 116 of the box. The tabs 112 also surround a perimeter of the box 102 on the walls 121*a-d*.

Figure 3:
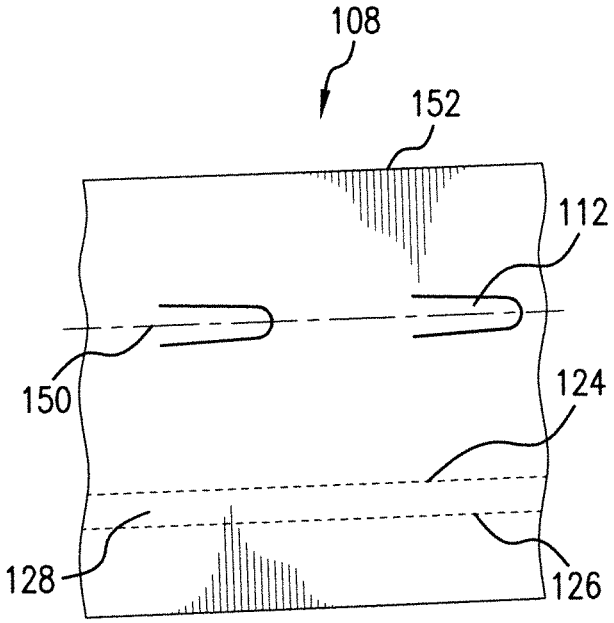
FIG. 3 shows a partial view of a panel for forming a box according to the embodiment shown in FIG. 2.

Further details of the perforations are shown in FIG. 3 in a partial view of a side wall of a panel 108 to form the box. The row of tabs 112 are aligned on the lateral row of panels 108*b* so that the tabs 112 are aligned along a longitudinal centerline 150 between the first line of weakness 124 and a top 152 of the row of lateral panels 108*b*. This keeps the tabs 112 centered when a display strip is formed (shown below in FIGS. 6-7).

Figure 4:
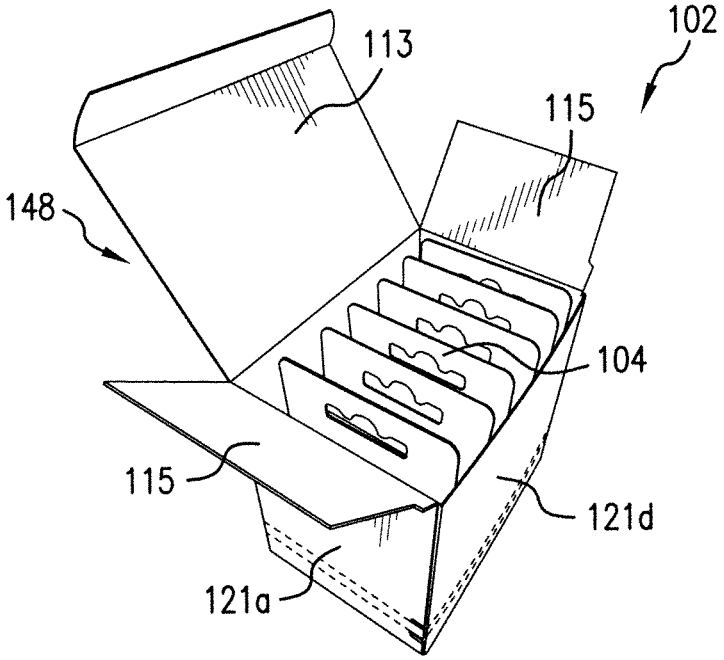
FIG. 4 shows a top perspective view of an open box containing items according to one embodiment of the invention.

FIG. 4 shows the box 102 in an open position 148. The open position 148 reveals a plurality of objects 104 inside the box. The box 102 can be sized and configured differently according to the size, shape and quantity of objects desired to fit inside the box. Likewise, the size, shape and location of the tabs and circular perforation may also vary according to the characteristics of the objects. In one embodiment, the box 102 holds objects 104. Preferably, the objects 104 are stored inside the box 102 for transporting the objects. Once transported, the objects 104 are displayed by modifying the box 102.

Figure 5:
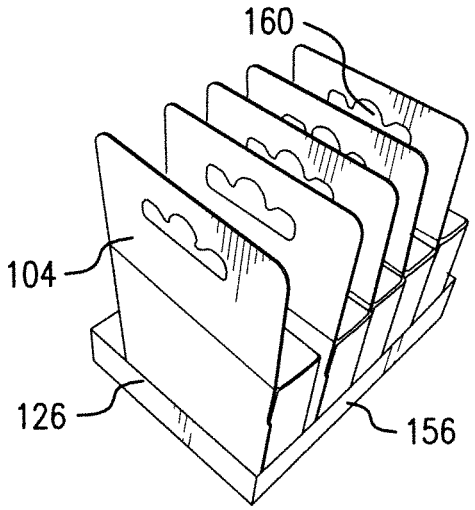
FIG. 5 shows a perspective view of a tray containing items according to one embodiment of the invention.

FIG. 5 shows a tray 156 formed from a portion of the box. The tray 156 is used to display the objects 104. The tray 156 is created by removing the perforated strip 128 from the box 102. The perforated strip 128 can be grasped at the tear tab 134 to then remove the strip 128 at the perforated lines 124, 126 from around the perimeter of the box. This results in a bottom portion of the box 102 becoming the tray 156, by splitting the box into two pieces. Boxes according to embodiments of this invention may include features other than the perforated strip to split the box into two pieces (such as a single perforated line of weakness, a cutting guide for a knife/scissors, a removable wire around the perimeter of the box, among others). As the objects 104 were already in the box 102, the objects 104 can simply remain in the same position as they were during transport. In addition, the objects are now conveniently displayed in the tray 156. The remaining top portion of the box that was removed after removing the perforated strip 128 can either be discarded or further modified into another display option.

Figure 6:
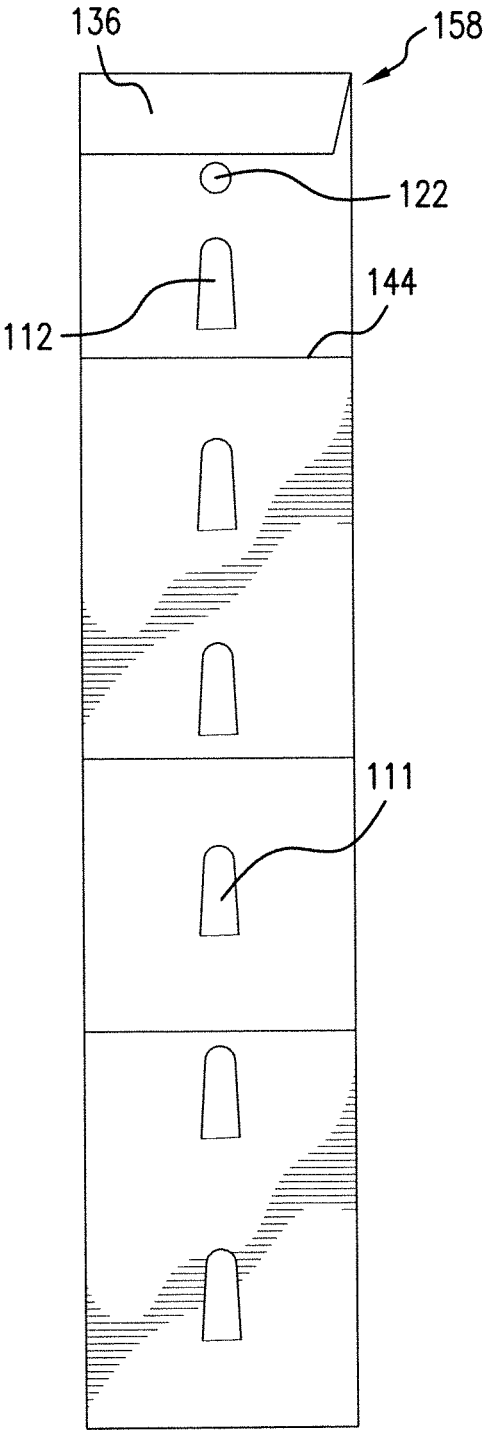
FIG. 6 shows a display strip according to one embodiment of the invention.

FIG. 6 shows a display strip 158 formed from another portion of the box.

The display strip 158 is formed after the perforated strip 128 is removed from the box. The top 114 of the box is also removed by detaching the lid flap 113 and two side flaps 115 from the walls 121*a*, 121*b* and 121*c* at the line of weakness 110. The line of weakness 110 is preferably perforated. The line of weakness 110 can also be scored and the flaps 113, 115 cut from the box. The sealing flap 136 is left attached to the front wall 121*a*, but the sealing flap 136 is detached from the second side wall 121*d* at the line of weakness 142. This line of weakness 142 is also preferably perforated for easy removal. After detachment of the front wall 121*a* from the second side wall 121*d* at the line of weakness 142, the row of lateral panels 108*b* can be unfolded from a box-shape, into the display strip 158. The display strip is preferably rectangular, although other shapes may be used as well.

The display strip 158 is oriented so that the circular perforation 122 can be punctured, and the display strip 158 hung from a hole left by the circular perforation 122. The display strip 158 can be hung in a variety of ways depending on need. For example, in a retail setting, the display strip 158 can be hung on a retail clip strip, a wire display, or a ball waterfall, among other fixtures. The circular perforation 122 can also be die-cut into the sheet that forms the blank and may include other shapes and sizes. The tabs 112 are punctured and pulled slightly away from the plane of the row of lateral panels 108*b*. Alternatively, the display strip 158 may include tabs 111. Tabs 111 can be printed with a color contrasting the surrounding color of the display strip. As such, tabs 111 are easily recognized for positioning and hanging objects. The tabs can also be die-cut into the sheet that forms the blank. In some embodiments of the invention, the tabs may be aligned in other patterns and locations across the display strip.

Figure 7:
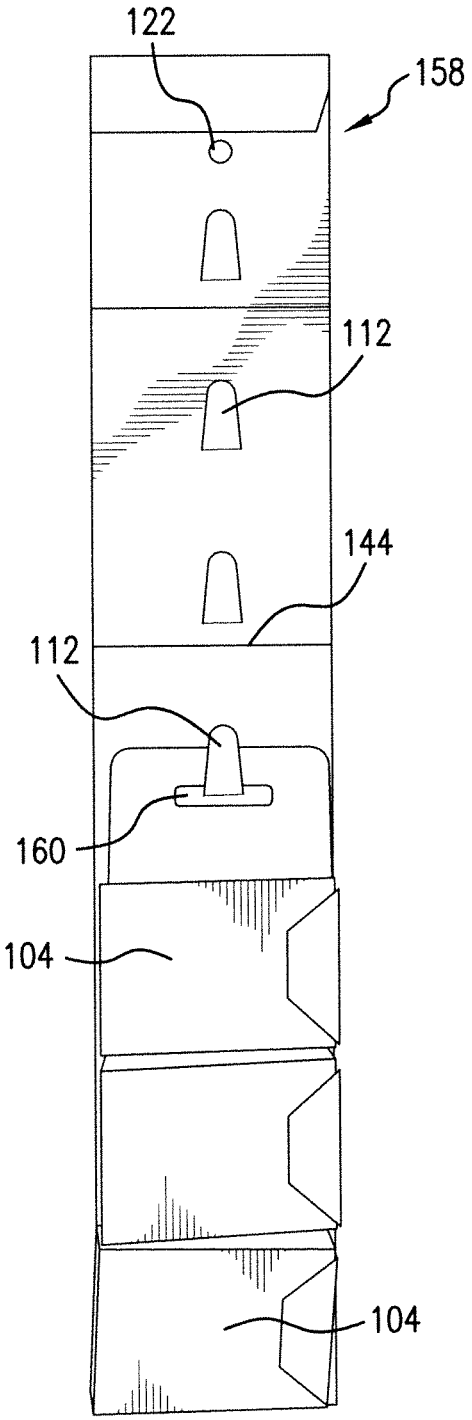
FIG. 7 shows a display strip containing items according one embodiment of the invention.

An object 104 from the plurality of objects 104 is then hung on a tab 112, as shown in FIG. 7. Preferably, each object of the plurality of objects 104 has an aperture 160 through which a tab can be inserted. The aperture can be a die-cut portion of the object, or the object can include a hook feature as a part of the object design or a container design that encloses the object. A variety of designs, shapes and styles can be used to hang the objects from the tabs. In one embodiment of the invention, the box holds six objects. The box therefore also has six tabs for holding each of the six objects.

Figure 8:
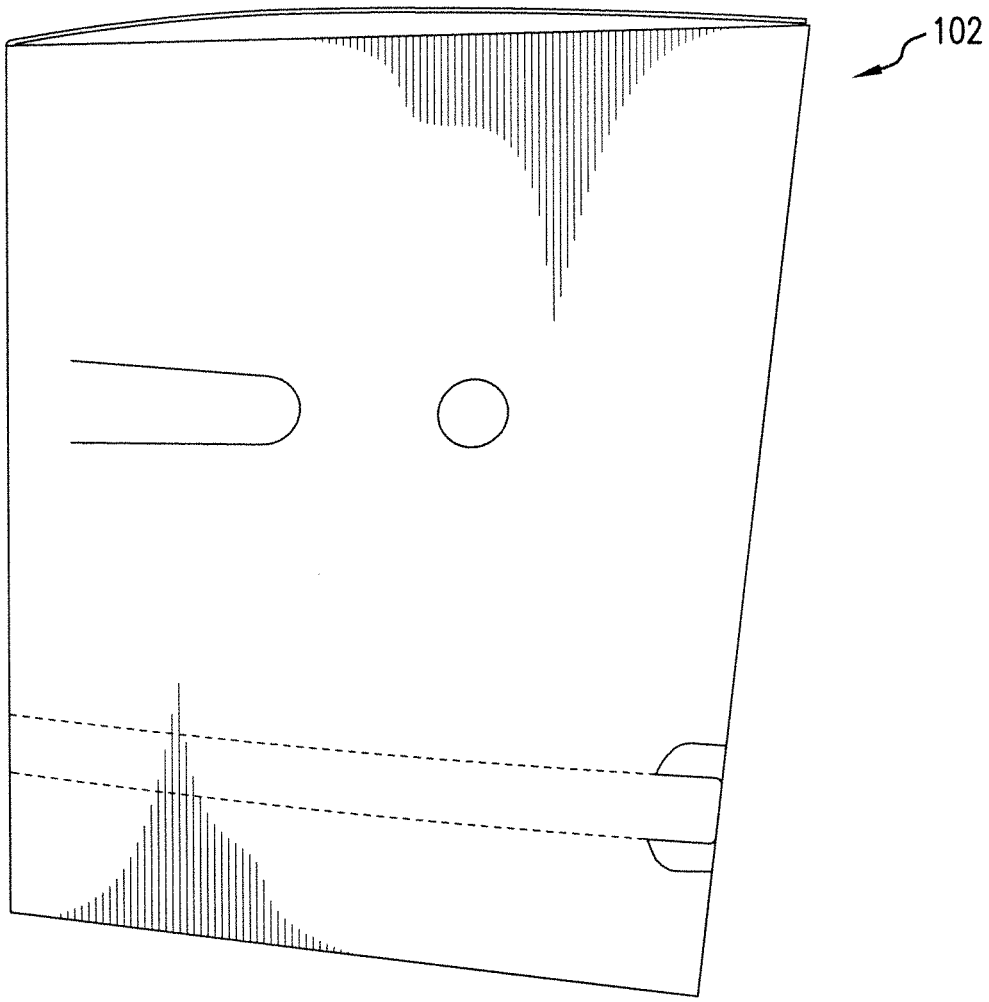
FIG. 8 shows a box according to one embodiment of the invention.

FIG. 8 shows a box 102 according to one embodiment of the invention. The box 102 includes instructions and markings for making one or more display options using the box 102. Such instructions may be printed onto parts of the box 102 so as to assist consumers or retail providers in creating a display tray and/or display strip.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. A blank for forming a box for packaging and displaying objects, the blank comprising:

a flexible sheet having a plurality of panels adapted to fold into a box;

a perforated line of weakness extending between rows of the plurality of panels; and a plurality of tabs in a lateral row along at least one row of the plurality of panels, wherein the row of lateral panels comprises a first line of weakness extending transversely across a width of the row of lateral panels and a second line of weakness extending transversely across the width of the row of lateral panels, wherein the second line of weakness is parallel to the first line of weakness, wherein the first line of weakness and the second line of weakness are perforated, forming a perforated strip, wherein the perforated strip is removable from the sheet.

2. The blank for forming a box according to claim 1 wherein the plurality of panels comprises:

a row of lateral panels along the flexible sheet;

a row of top panels above the lateral panels; and a row of bottom panels below the lateral panels.

3. The blank for forming a box according to claim 1 wherein the row of top panels is configured to form a top of the box, wherein the top comprises a lid flap and two opposing side flaps.

4. The blank for forming a box according to claim 1 wherein the row of bottom panels is configured to form a bottom of the box, wherein the bottom comprises two sets of transverse flaps, the two sets of transverse flaps configured to fit inside one another to form the bottom of the box.

5. The blank for forming a box according to claim 1 wherein the row of lateral panels comprises four lateral panels configured to form four walls of the box, the four walls comprising a front wall, a rear wall, a first side wall, and a second side wall.

6. The blank for forming a box according to claim 1 wherein a first panel of the row of lateral panels comprises a circular perforation, wherein the circular perforation is at one end of the tabs, in line with the tabs, and wherein the tabs protrude from the first panel.

7. The blank for forming a box according to claim 1 wherein the first panel of the row of lateral panels comprises a void on a first outside edge of the sheet, wherein the void is aligned with the perforated strip.

8. The blank for forming a box according to claim 7 wherein the perforated strip comprises a tear tab for detaching the perforated strip from the sheet, wherein the tear tab extends through the void.

9. The blank for forming a box according to claim 1 wherein the fourth panel of the row of lateral panels comprises a sealing flap on a second outside edge of the sheet, wherein the sealing flap comprises a void aligned with the perforated strip.

10. The blank for forming a box according to claim 9 wherein the sheet further comprises a perforated line of weakness between the fourth panel and the sealing flap, wherein the perforated line of weakness extends a length of the sealing flap.

11. The blank for forming a box according to claim 10 wherein the sheet further comprises a line of weakness between each panel of the row of lateral panels, wherein the lines of weakness extend longitudinally, down a length of the row of lateral panels.

12. The blank for forming a box according to claim 11 wherein the sealing flap is configured to attach to the first outside edge of the sheet, thereby connecting the fourth panel to the first panel, when creating the box, wherein the row of lateral panels folds along the lines of weakness.

13. A box for holding and displaying a plurality of articles, the box comprising:

a top comprising a foldover flap, and two side flaps, wherein the foldover flap is moveable between a closed position and an opened position;

a bottom comprising a plurality of bottom flaps for closing the bottom of the box;

a plurality of side walls foldably connected to a sealing flap;

wherein a first side wall of the plurality of side walls is foldably connected to a side flap of the two slide flaps along a perforated line of weakness and wherein the first side wall is foldably connected to a bottom flap of the plurality of bottoms flaps along a scored line of weakness;

wherein a second side wall of the plurality of side walls is foldably connected to the first side wall along a scored line of weakness, wherein the second side wall is foldably connected to the foldover flap along a perforated line of weakness and wherein the second side wall is foldably connected to a bottom flap of the plurality of bottom flaps along a scored line of weakness;

wherein a third side wall of the plurality of side walls is foldably connected to the second side wall along a scored line of weakness, wherein the third side wall is foldably connected to a side flap of the two side flaps along a perforated line of weakness and wherein the third side wall is foldably connected to a bottom flap of the plurality of bottoms flaps along a scored line of weakness;

wherein a fourth side wall of the plurality of side walls is foldably connected to the sealing flap along a length of the fourth side wall along an at least partially perforated line of weakness, wherein the fourth side wall is foldably connected to a bottom flap of the plurality of bottoms flaps along a scored line of weakness;

wherein the sealing flap of the fourth side wall is attachable to the first side wall along a length of the first side wall;

a first perforated line of weakness extending transversely across a width of the plurality of side walls;

a second perforated line of weakness extending transversely across the width of the plurality of side walls, wherein the second line of weakness is parallel to the first line of weakness, forming a perforated strip;

a plurality of tabs in a lateral row along the plurality of side walls, wherein the lateral row is configured along a centerline between the first perforated line of weakness and a top of the plurality of side walls; and a circular perforation on the first side wall along the lateral row, wherein u-bends of the tabs point towards the circular perforation.

14. The box for holding and displaying a plurality of articles according to claim 13, further comprising a void on an edge of the first side wall, wherein the void is aligned with the perforated strip, and wherein the perforated strip comprises a tear tab extendable into the void, and wherein the perforated strip is configured to be removed from the box with the tear tab to create a tray to display the plurality of articles, wherein the tray comprises the bottom of the box and a portion of the plurality of side walls.

15. The box for holding and displaying a plurality of articles according to claim 14 wherein the foldover flap and the two side flaps of the top of the box are configured to be removed from the plurality of side walls at the perforated lines of weakness, wherein the sealing flap is configured to be removed from the fourth side wall at the perforated line of weakness to create a display strip to display the plurality of articles wherein the display strip is configured for a hangable display by the circular perforation, and wherein an article of the plurality of articles is configured for a hangable display on a tab, wherein the tab is identified by a contrasting color from the hangable display.

16. A blank for forming a box for packaging and displaying objects, the blank comprising:

a plurality of panels adapted to fold into the box, wherein the plurality of panels comprise a series of top panels, wherein the series of top panels are removed from the plurality of panels at a plurality of perforated points;

a first perforated line of weakness extending between rows of the plurality of panels;

a second perforated line of weakness extending between rows of the plurality of panels, wherein the second perforated line of weakness is parallel to the first perforated line of weakness wherein the first perforated line of weakness and the second perforated line of weakness comprise a removeable strip, wherein the removeable strip is removable from the plurality of panels;

a plurality of tabs in a lateral row along at least one row of the plurality of panels; and a circular perforation on an end of the lateral row, wherein u-bends of the tabs point towards the circular perforation.

* * * * *